US007096545B2

(12) United States Patent
Uehara et al.

(10) Patent No.: US 7,096,545 B2
(45) Date of Patent: Aug. 29, 2006

(54) BUCKLE

(75) Inventors: Ryoichiro Uehara, Kurobe (JP); Kayo Fujimoto, Tokyo (JP); Yasutaka Nishida, Tokyo (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 10/817,588

(22) Filed: Apr. 2, 2004

(65) Prior Publication Data

US 2005/0091808 A1 May 5, 2005

(30) Foreign Application Priority Data

Apr. 11, 2003 (JP) ..... 2003-108225

(51) Int. Cl.
*A44B 11/25* (2006.01)
*A44B 11/00* (2006.01)

(52) U.S. Cl. ..... 24/614; 24/615; 24/625; 24/662

(58) Field of Classification Search ..... 24/614, 24/615, 625, 662, 664
See application file for complete search history.

(56) References Cited

U.S. PATENT DOCUMENTS

| | | | | |
|---|---|---|---|---|
| 4,672,725 | A * | 6/1987 | Kasai | 24/625 |
| 4,712,280 | A | 12/1987 | Fildan | 24/625 |
| 4,991,272 | A | 2/1991 | Bianchi | 24/616 |
| 5,027,481 | A | 7/1991 | Frano | 24/606 |
| 5,791,026 | A | 8/1998 | Anscher | 24/615 |
| 5,806,152 | A * | 9/1998 | Saitou et al. | 24/662 |
| 6,311,374 | B1 * | 11/2001 | Anscher | 24/625 |
| 6,363,590 | B1 | 4/2002 | Lan | 24/614 |
| 6,487,761 | B1 * | 12/2002 | Van Tassel | 24/606 |
| 2002/0040515 | A1 | 4/2002 | Uehara et al. | 24/614 |
| 2003/0145439 | A1 | 8/2003 | Chao | 24/306 |

FOREIGN PATENT DOCUMENTS

| | | | | |
|---|---|---|---|---|
| JP | 06125803 | A * | 5/1994 | 24/163 R |
| JP | 6-154013 | | 6/1994 | |
| JP | 7-51106 | | 2/1995 | |
| JP | 2000-166616 | | 6/2000 | |
| JP | 2001-346612 | | 12/2001 | |

* cited by examiner

*Primary Examiner*—Daniel P. Stodola
*Assistant Examiner*—Ruth C. Rodriguez
(74) *Attorney, Agent, or Firm*—Everest Intellectual Property Law Group; Michael S. Leonard

(57) ABSTRACT

A buckle includes a socket (10), a plug (20) of which tip end part can be inserted into and released from the socket by pressing both sides of the socket by a manual operation. The plug has a base (21) located on a base end of the plug, a pair of lock arms (22) extending to the tip end of the plug from the base, an engaging part (24) provided on the intermediary of the lock arm and engageable with the inside of the socket, a pressing part (25) provided on the intermediary of the lock arm and pressed by the manual operation, and a bridge (30) for connecting the intermediaries of the lock arms.

5 Claims, 5 Drawing Sheets

BUCKLE

BACKGROUND OF THE INVENTION

1. Field of the Invention

The present invention relates to a buckle for fastening a belt, especially to a side-release buckle or a side-push buckle disengageable by pressing lateral sides of the buckle by a manual operation.

2. Description of Related Art

Conventionally, clothes, bags, helmets, baby carriages, sporting goods or the like have often employs a fastening with a strip-shaped material such as a belt or a tape. For such fastening, a buckle that can be attached to a belt etc. and manually locked/unlocked has been used.

Typically, a buckle can be locked when a plug (male member) is inserted into a socket (female member) and pushed until it clicks (until it reaches a certain phase).

A buckle disclosed in U.S. Pat. No. 5,791,026 (prior art 1) has a flat tubular socket and a plug inserted into the socket. The socket has a belt-holding part or an attachment part for attaching to a sheet or the like, and apertures are formed on both lateral sides thereof. The plug has a belt-holding part located on a base end of the plug, a guide bar provided at its center extending to a tip end from the base end, and a pair of lock arms to be disposed at the both sides and to be extended to the tip end of the plug from the base end pf the plug. The lock arms are made of flexible material and provided with engaging parts on an outer sides to be engageable with the inside of the socket.

With this structure, by inserting the plug into the socket, the lock arms are engaged with the inside of the socket to couple the plug with the buckle. Then by pressing the lock arms of the plug with a hand, the pair of lock arms are flexed inward to be disengaged from the inner side of the socket, thereby readily decoupling the buckle. Such type of buckle is so called a side-release buckle, a side-push buckle or the like.

In such side-release buckle, the pair of lock arms, the guide bar and the like are respectively projected from the plug. Therefore, the lock arms located outside can unexpectedly catch other material thereon while the plug being released from the socket, and may be overextended outward, thereby causing their breakage. When axes of the plug and the socket are misaligned at the insertion of the plug into the socket, one of the lock arms may be out of the socket. If the plug is further inserted, the lock arm may be overextended outward, thereby causing the breakage.

With respect to such problem, the buckle disclosed in the prior art 1 is provided with a retaining strap so as to connect approximately tip end of each lock arm with the intermediary of the guide bar. The retaining strap is made of flexible material and formed in V-shape. More specifically, the retaining strap is integrally molded with each lock arm, a guide bar and a plug base. The retaining strap is disposed so as to be V-shaped opening toward the tip ends of the respective lock arms.

The retaining strap does not interfere the movement of the lock arm since it is integrally flexed with the lock arm when the lock arm is deformed inward while the plug being inserted into the socket. When the lock arm is overextended outward, the retaining strap is extended until straightened to restrict any further overextension of the lock arm, thereby preventing such breakage described above. Further, the retaining strap prevents a rim of the socket or other material from getting into a space between each lock arm and the guide bar so that overextension of the lock arm can be avoided.

A buckle disclosed in Japanese Patent Laid-Open Publication No. 2000-166616 (prior art 2) prevents outward extension of a lock arm as the prior art 1, and facilitates its operation. In a buckle of the prior art 2, a plug is provided with a pair of lock arms and a guide bar as in the prior art 1.

According to such buckle, a base end of the lock arm is connected to a plug base, and a tip end of the lock arm is connected to a tip end of the guide bar, thereby providing an effect for restricting plastic deformation of the lock arm, being similar as the effect for restricting overextension due to the retaining strap described in the prior art 1. Note that the buckle of the prior art 2 is characterized in that the side of the base end of the lock arm (the side connected to the plug base) is formed thinner than the side of the tip end thereof (the side connected to the guide bar), thereby improving the deformability. The lock arm rotates around the tip end of the guide bar as a pivot point.

The prior art 1 shows that the retaining strap is V-shaped in order to readily realize compressive deformation. However, since the retaining strap is disposed at the narrow space between each lock arm and the guide bar, the retaining strap part in each side is largely deformed upon the coupling/decoupling of the buckle, therefore, the buckle still needs extra pressing force for being decoupled.

Since the retaining strap is disposed so as to connect approximately each tip end of the lock arms with the intermediary of the guide bar, a recess is formed between the tip ends of the lock arms and the guide bar, therefore, the recess cannot sufficiently prevent other material from hanging-up hereinto.

The prior art 2 can sufficiently resolve the hanging-up to other material since each lock arm in each side is connected to the tip end of the guide bar.

However, the lock arm cannot be smoothly coupled with the guide bar, therefore, the buckle still needs extra pressing force for being decoupled.

BACKGROUND OF THE INVENTION

An object of the present invention is to provide a buckle of a side-release type or a side-push type, which can avoid breakage of a lock arm due to overextension and sufficiently facilitate a manual operation for decoupling the buckle.

A buckle according to an aspect of the present invention includes: a socket; a plug having a tip end to be inserted to the socket and to be released from the socket by pressing from both sides of the socket, the plug having a base formed on a base end, at least a pair of lock arms extending from the base to the tip end of the plug, an engaging part formed on a part of the lock arm to be engageable with the socket, and a pressing part disposed at a part of the lock arm to be pressed when the socket is released; and a bridge connecting the parts of at least the pair of lock arms.

According to the above arrangement, the bridge restricts overextension of the lock arm to prevent its breakage. Further, since at least the pair of lock arms is connected together, the bridge can be positioned at a sufficiently wide space compared to the conventional buckle at which the bridge is connected to the guide bar, thereby allowing flexible deformation and a smooth operation for decoupling the buckle.

Preferably, in the buckle of the above aspect of the present invention, both ends of the bridge are connected to the lock arms, and a central part of the bridge is located on the side of the tip end of the plug relative to the both ends.

With such configuration, the bridge is so disposed to be close to the tip end as a whole, therefore, the lock arm more securely prevents other material from getting hereinto.

Preferably, in the buckle of the above aspect of the present invention, the both ends of the bridge are located on the side of the base end of the plug relative to the pressing part, and the central part of the bridge is located on the side of the tip end of the plug relative to the pressing part.

With such configuration, the bridge is positioned within an area where a manual operating force is applied onto the pressing parts, so that the bridge can readily receive the operation force thereby realizing smooth operation.

Preferably, in the buckle of the above aspect of the present invention, the bridge is approximately V-shaped bent at the central part.

With such configuration, the V-shaped bending part can induce deformation of the bridge, thereby realizing further smooth operation.

Preferably, in the buckle of the above aspect of the present invention, the center angle of the approximately V-shape is 90 degrees or less.

Accordingly, the angle being 90 degrees or less defines a round configuration which can be readily deformed when the bridge is pressed via the both ends, although the angle being more than 90 degrees defines a linear-like connection between both ends, and it would be more linear as the angle increases. Therefore, smooth operation can be further emphasized.

A buckle according to another aspect of the present invention includes: a socket; a plug having a tip end to be inserted to the socket and to be released from the socket by pressing from both sides of the socket, the plug having a base formed on a base end, at least a pair of lock arms extending from the base to the tip end of the plug, at least one guide bar disposed between the lock arms, an engaging part formed on a part of the lock arm to be engageable with the socket, and a pressing part disposed at a part of the lock arm to be pressed when the socket is released; and a bridge connecting the parts of at least the pair of lock arms and extending around a tip end of the guide bar.

According to the above arrangement, the bridge restricts overextension of the lock arm to prevent its breakage as in the case without the guide bar. Further, since the bridge connects at least the pair of lock arms together, it can be positioned at a sufficiently wide space compared to the conventional buckle at which the bridge is connected to the guide bar, thereby allowing flexible deformation and a smooth operation for decoupling the buckle.

Preferably, in the buckle of the above aspect of the present invention, the tip end of the guide bar is located on the side of the tip end of the plug relative to the both ends of the bridge and the bridge extending around the tip end of the guide bar at the central part thereof.

With such configuration, when the lock arm is overextended, the bridge is flexed and contacts the tip end of the guide bar thereby restricting overextension of the lock arm. At this time, if the tip end of the guide bar is located on the side of the tip end of the plug relative to the both end of the bridge, the bridge can restrict overextension of the lock arm while bending. That is, the bridge is further bent to reduce pressing force under ordinary condition and to restrict overextension of the lock arm in an earlier step of its deformation. Further, an adjustment of the contacting position with the tip end of the guide bar can control the timing to restrict overextension.

DETAILED DESCRIPTION OF PREFERRED EMBODIMENT(S)

Embodiments of the present invention will be described below with reference to attached drawings.

Figure 1:
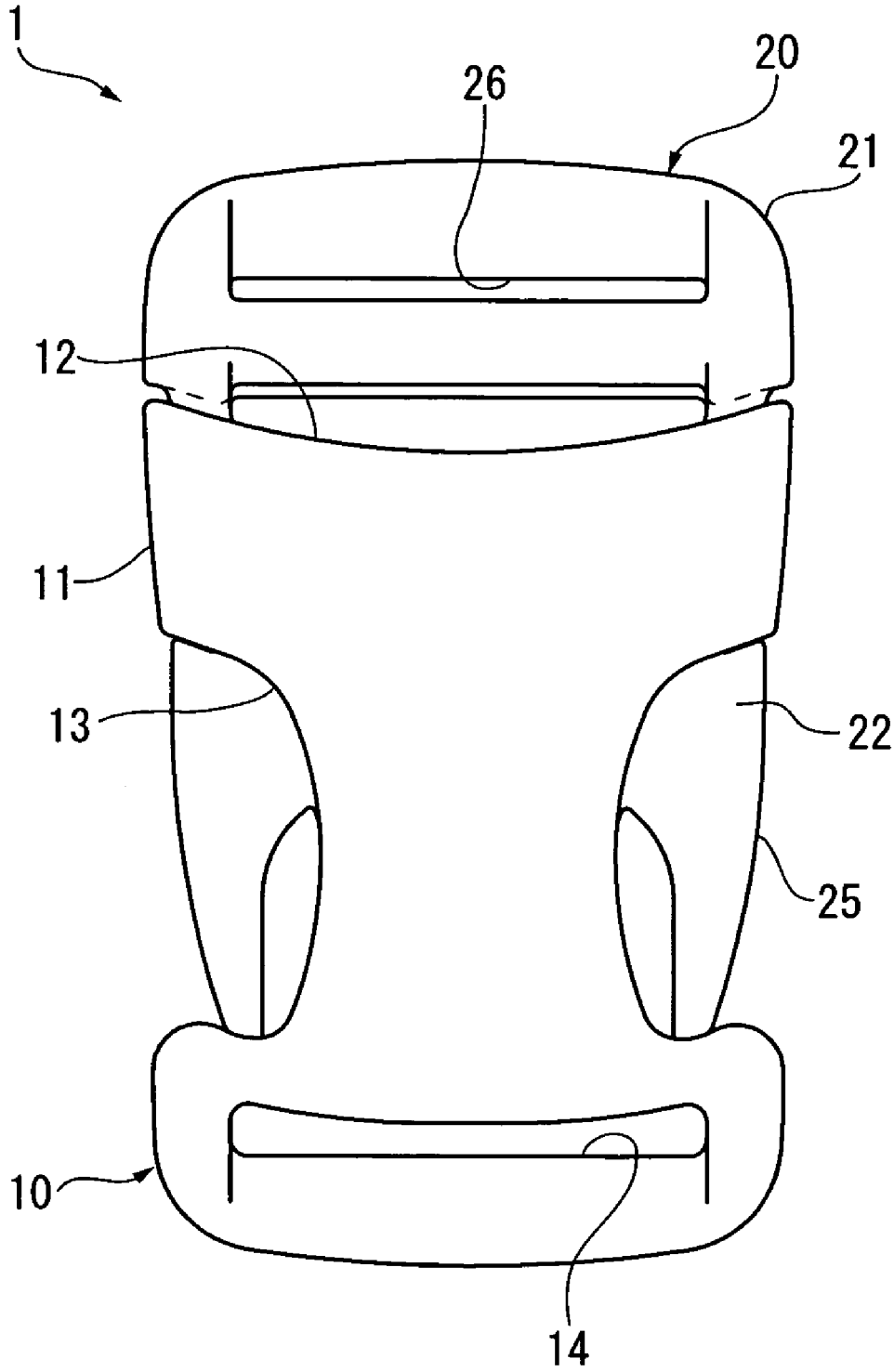
FIG. 1 is a front elevational view showing a coupled state of a buckle according to a first embodiment of the present invention.
Figure 2:
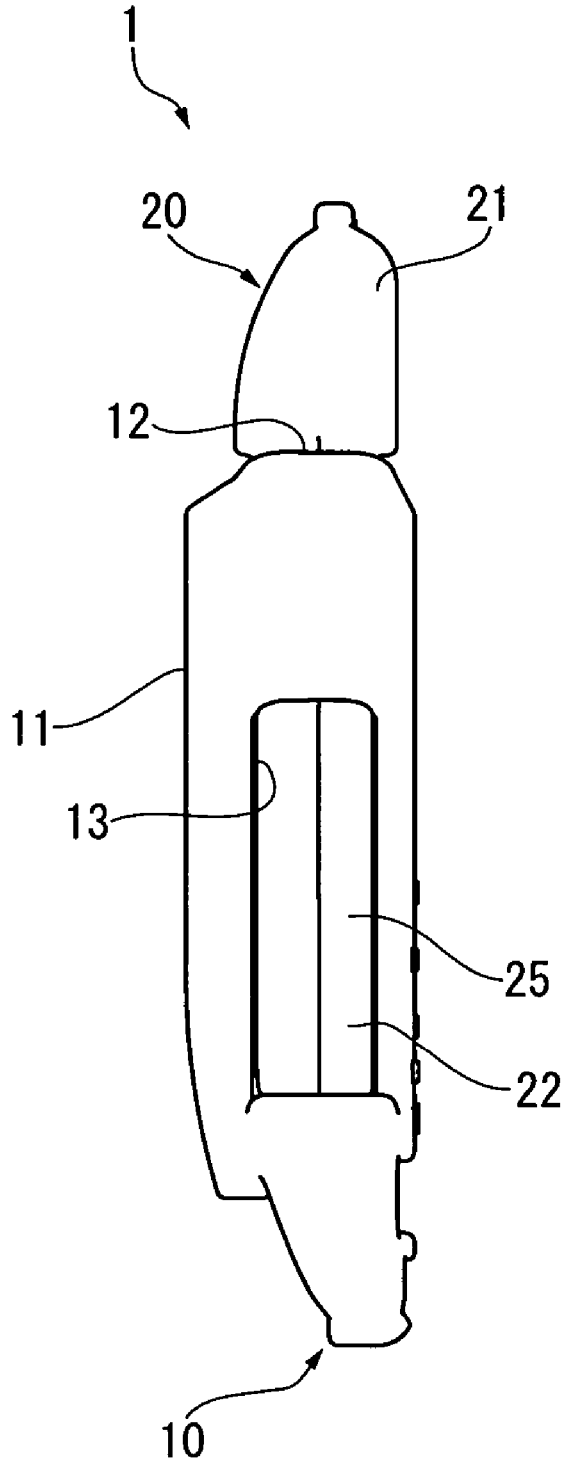
FIG. 2 is a side elevational view showing the coupled state of the buckle according to the first embodiment.
Figure 3:
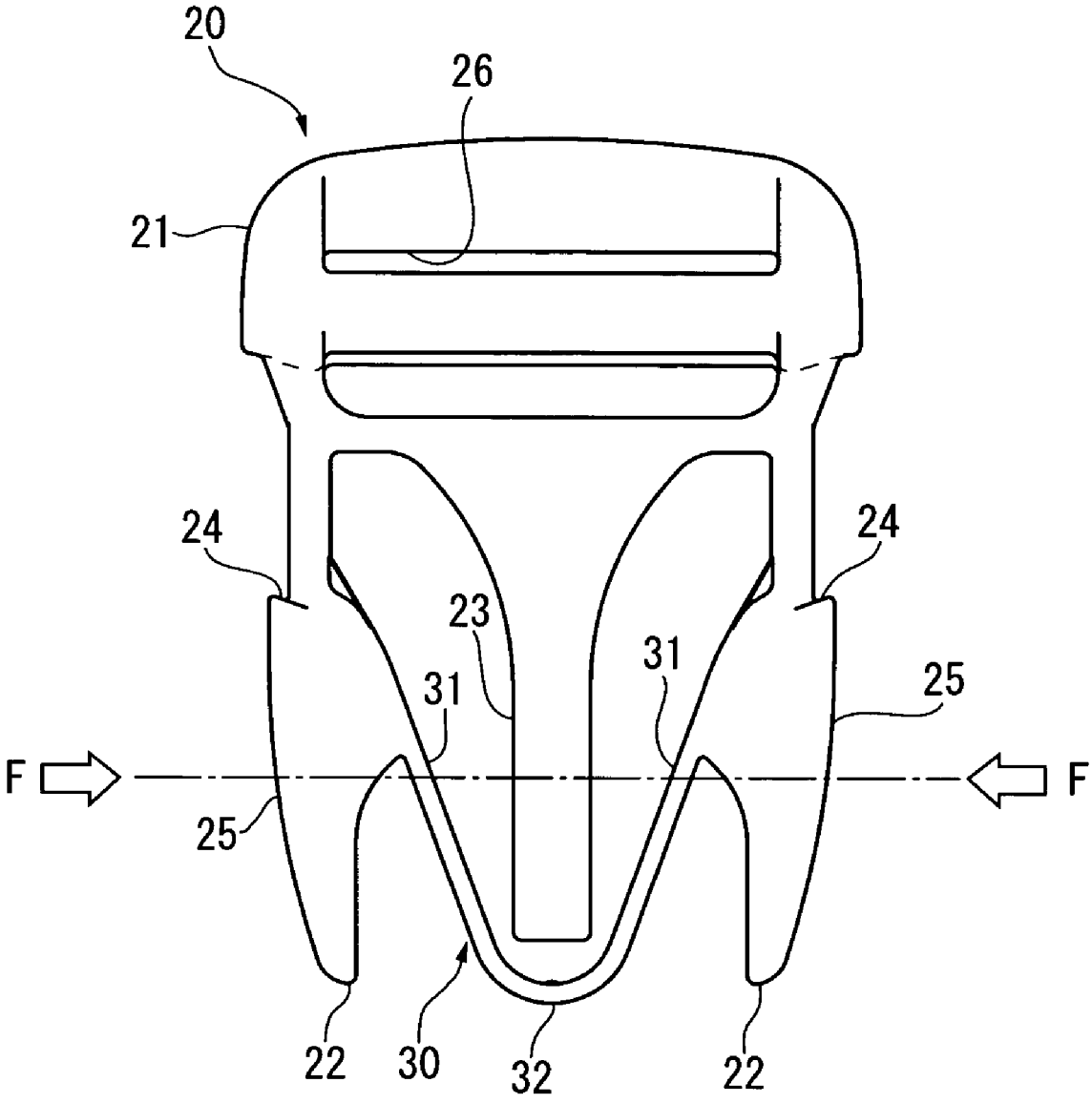
FIG. 3 is a front elevational view showing a plug of the buckle according to the first embodiment.

FIGS. 1 to 3 are illustrations each showing a first embodiment of the present invention.

In FIGS. 1 and 2, a side-release buckle 1 of this embodiment has a socket 10 and a plug 20.

The socket 10 integrally molded of synthetic resin has a flat tubular main body 11. The main body 11 has an insertion slot 12 at a tip end of the socket 10, into which the plug 20 is inserted, a pair of operation apertures 13 in each lateral side to disengage the plug 20, and a holding slot 14 at a base end of the socket 10 to secure a belt etc. The insertion slot 12 and the operation aperture 13 are communicated with a cavity inside the main body. Engaging parts (not shown) are formed on the inside of the main body 11 to engage with a tip end part of the plug 20 inserted from the insertion slot 12.

The plug 20 is integrally molded of synthetic resin. The tip end of the plug 20 can be inserted into and released from the socket 10 by manually pressing the both sides of the socket 10.

As shown in FIG. 3, the plug 20 has a base 21 provided at the base end, a pair of lock arms 22 extending to tip end of the plug 20 from the base 21, a guide bar 23 disposed between the lock arms 22. The lock arms 22 and the guide bar 23 define the tip end part of the plug 20, which is inserted into the socket 10.

There are an engaging part 24 engageable with a corresponding engaging part located on the inside of the socket 10 and a pressing part 25 to be pressed by a manual operation on the intermediaries of the lock arms 22. The pressing part 25 is exposed through the operation aperture 13 of the socket 10 for enabling the manual operation while the plug 20 being inserted into the socket 10. A holding slot 26 is provided at the base 21 to secure a belt etc.

A bridge 30 is formed between the pair of lock arms 22 to connect the intermediaries of the lock arms 22. The bridge 30 is formed when the plug 20 is integrally molded.

Both ends 31 of the bridge 30 are connected to mutually facing surfaces of the lock arms 22. The both ends 31 are located at each backside of the pressing parts 25 of the lock arms 22, and locations thereof are located on the side of the base 21 relative to an expected position to which a pressing force F for decoupling of the buckle 1 is applied.

The bridge 30 extends around a tip end of the guide bar 23 at the central part 32 thereof. The bridge 30 is approximately V-shaped, and an angle where linear parts in each side of the central part 32 meet each other, i.e., a center angle of the central part 32, is approximately 60 degrees. Note that the central part 32 has no obviously sharpened angle, but a circular arc.

The tip end of the guide bar 23 is adequately disposed at the side of the tip end of the plug 20 relative to the expected position of a pressing force F. The central part 32 extending around the tip end of the guide bar 23 is disposed so as to have a predetermined space between the central part 32 and the tip end of the guide bar 23 under ordinary condition. In other words, when the pair of lock arms 22 extends outward, the bridge 30 is pulled toward the both sides and the center angle thereof is enlarged so that the central part 32 contacts the tip end of the guide bar 23.

According to the embodiment, following operation is worked out.

When the plug 20 and socket 10 are coupled, the tip end part of the plug 20, i.e. the lock arm 22 and the guide bar 23 are inserted into the insertion slot 12 of the socket 10. Postures of the main body 11 of the socket 10 and the plug 20 are thus relatively aligned according to the guide bar 23, and the engaging part 24 of the lock arm 22 is engaged with the inside of the main body 11 by further insertion.

When the plug 20 and the socket 10 are decoupled, the pressing parts 25 of the lock arms 22 exposed through the operation apertures 13 of the socket 10 are manually pressed to mutually deform the pair of lock arms 22 inward. With such deformation, the engaging part 24 of the lock arm 22 is disengaged from the inner side of the main body 11 thereby releasing the plug 20 from the socket 10.

The bridge 30 is integrally deformed when the pair of lock arms 22 is mutually deformed inward during disengagement. In such situation, the manual disengagement is smoothly worked out since the deformation is flexible due to the large center angle although the center angle of the bridge 30 becomes less than the initial angle of 60 degrees.

In the embodiment, the plug 20 prevents other material from getting hereinto by the bridge 30 during disengagement, although the prior art has a large gap between the lock arms 22 and the guide bar 23.

In case that other material or a rim of the insertion slot 12 of the socket 10 gets into the gap during engagement, the lock arm 22 is overextended outward and may be broken. In the present invention, in case that the lock arm 22 is overextended outward, the bridge 30 is integrally stretched to resist overextension of the lock arm 22. When the further extension is occurred, the central part 32 contacts the guide bar 23 thereby securely restricting any further overextension.

According to the above-described embodiment, following advantages can be acquired.

The plug 20 according to the embodiment, the large gap between the lock arm 22 and the guide bar 23 during disengagement can prevent other material from getting hereinto by the bridge 30 connecting the lock arms 22 together.

In case that other material or a rim of the insertion slot 12 of the socket 10 gets into the gap during engagement and the lock arm 22 is overextended outward, the bridge 30 can resist overextension of the lock arm 22.

In case that the lock arm 22 is further extended, the central part 32 of the bridge 30 contacts the guide bar 23, thus securely restricting any further overextension by adequately setting distance between the central part 32 of the bridge 30 and the tip end of the guide bar 23.

The bridge 30 of the embodiment is approximately V-shaped with the center angle of 60 degrees. Therefore, the bridge 30 is flexibly bent and the force for manually pressing the pressing part 25 can be reduced during disengagement.

The bridge 30 is disposed in a manner such that the both ends 31 thereof are positioned at the side of the base end of the plug 20 and the central part 32 is positioned at the side of the tip end of the plug 20 relative to an axis of the force F for manually pressing the pressing part 25, thereby allowing flexible deformation and smooth operation.

The central part 32 of the bridge 30 is not a sharpened angle but a circular arc with a predetermined curvature, therefore repetitive deformations hardly cause a fatigue fracture thereby enhancing durability of the bridge 30.

The bridge 30 is integrally molded with the plug 20 as a whole thereby facilitating its manufacture. Since the bridge 30 connects the intermediaries of the pair of lock arms 22 together, a flow of melted resin can be bypassed thereby facilitating molding process.

Figure 4:
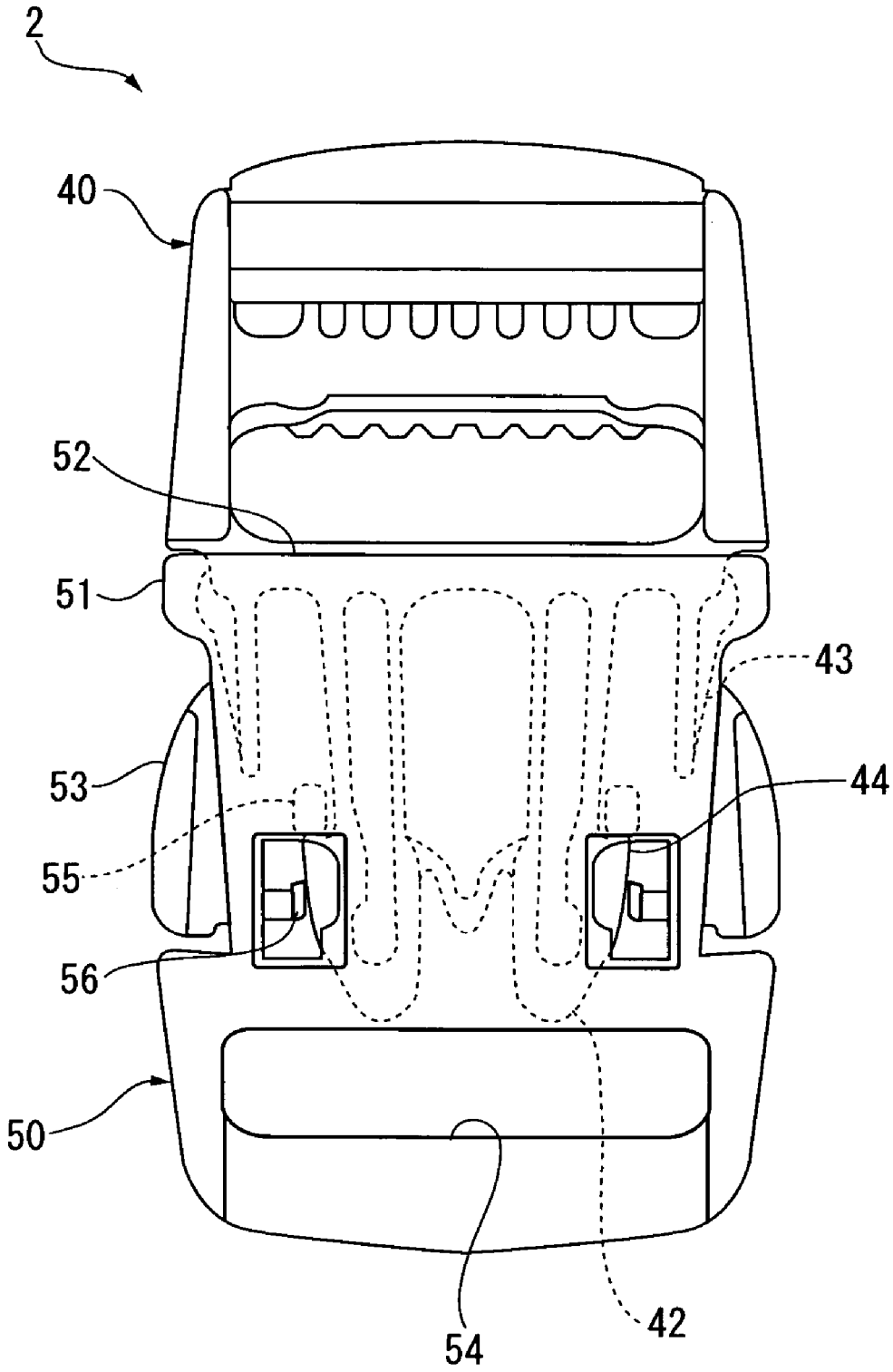
FIG. 4 is a front elevational view showing a coupled state of a buckle according to a second embodiment of the present invention.
Figure 5:
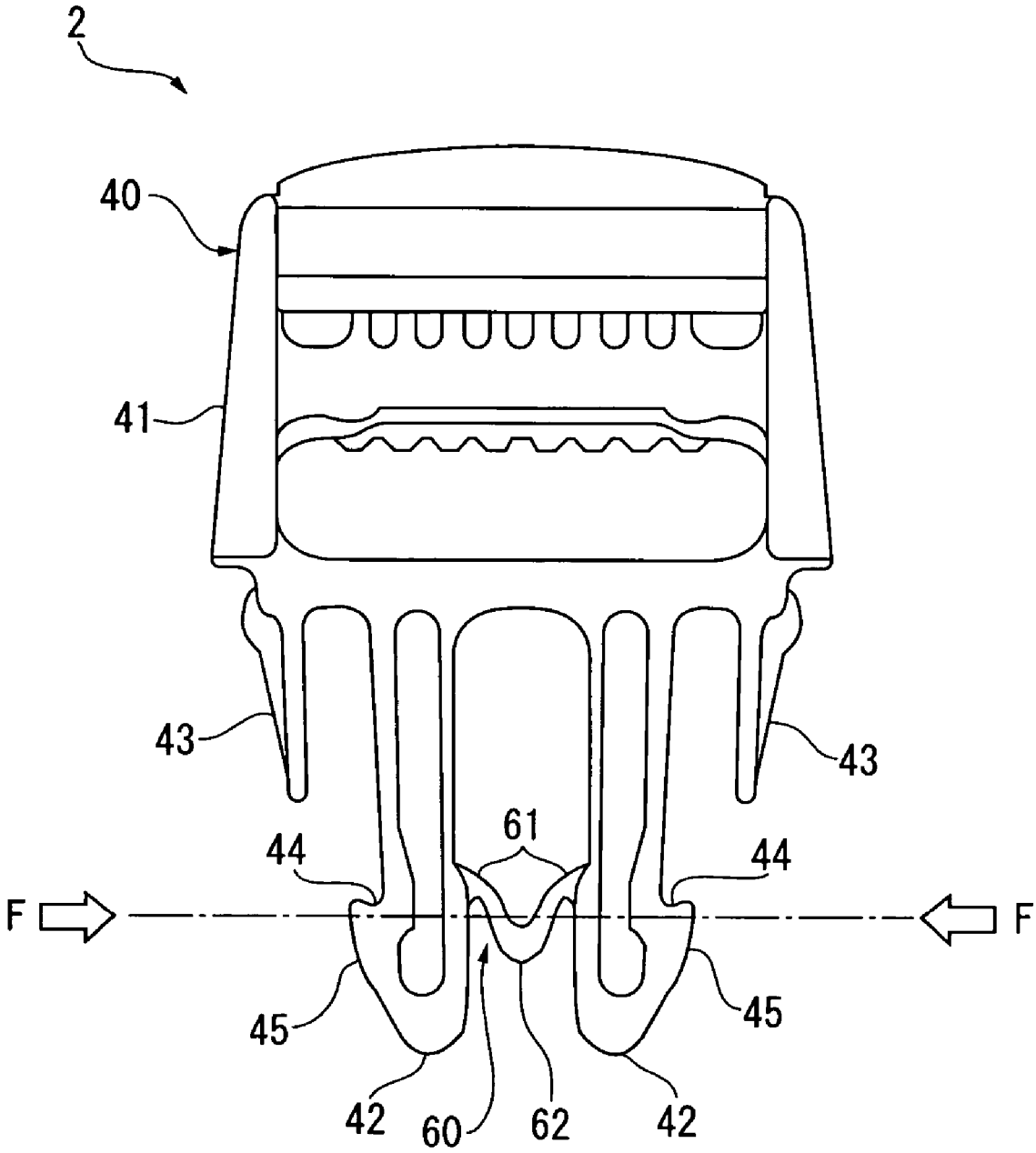
FIG. 5 is a front elevational view showing a plug of the buckle according to the second embodiment.

FIGS. 4 and 5 are illustrations each showing a second embodiment of the present invention.

In FIG. 4, a side-push buckle 2 has a plug 40 and a socket 50.

As shown in FIG. 5, the plug 40 has a base 41 and a pair of lock arms 42 as described in the first embodiment.

In this embodiment, however, a pair of guide bars 43 is provided on the outside of the lock arm 42.

There are an engaging part 44 engageable with a corresponding engaging part formed on the inside of the socket 50 and a pressing part 45 to be manually pressed on each intermediary of the lock arms 42 as described in the first embodiment.

In this embodiment, however, the pressing part 45 is not exposed while the socket being inserted. The pressing parts 45 are manually operated indirectly via movable parts provided on lateral sides of the socket 50 as described below.

As shown in FIG. 4, the socket 50 integrally molded of synthetic resin has a flat tubular main body 51 as described in the first embodiment. The main body 51 has an insertion slot 52 at a tip end part, into which the plug 40 is inserted, a pair of operation levers 53 on each lateral side to disengage the plug 40, and a holding slot 54 at a base end to secure a belt etc.

An engaging part 55 engageable with a corresponding engaging part 44 (described below) is formed on the inside of the socket 50 according to the embodiment. The operation lever 53 is connected to the main body 51 at an insertion slot 52 side thereof in an swing-able manner, and has a pressing projection 56 to be formed on the side of a holding 54 and to be extended to the inside of the socket 50. In a state that the pressing projection 56 is inserted into the socket 50, i.e., the engaging part 44 of the lock arm 42 (described later) is engaged with the corresponding engaging part 55, the pressing part 45 of the lock arm 42 is deformed by pressing. The deformation disengages the engaging parts 44 and 55, and allows the socket 50 to be decoupled from the plug 40.

As shown in FIG. 5, a bridge 60 is formed between the pair of lock arms 42 to connect intermediaries of the lock arms 42 as described in the first embodiment.

Both ends 61 of the bridge 60 are connected to mutually facing surfaces of the lock arms 42. The both ends 61 are located at each backside of the pressing parts 45 of the lock arms 42, the both ends 61 being located at the side of the base 41 relative to an expected position to which a pressing force F for decoupling of the buckle 2 is applied.

The bridge 60 is approximately V-shaped, and an angle where linear parts in each side of the central part 62 meet each other, i.e., a center angle of the central part 62, is 80 to 90 degrees.

According to the second embodiment, the same advantages as in the first embodiment can be obtained.

In the second embodiment, since the central part 62 of the bridge 60 does not contact the guide bar 43 unlike the first embodiment, therefore, a further effect cannot be obtained for restricting overextension of the lock arm 42 owing to the contact. In the second embodiment, however, the guide bars 43 on each side are disposed at the outside of the lock arms 42, therefore the guide bars 43 contact the lock arms 42 when the lock arms 42 are largely deformed outward thereby restricting further deformation. That is, in the embodiment, the further effect can be obtained for restricting overextension of the lock arms 42 by the guide bars 43 on each side.

Note that the scope of the present invention is not restricted to the above specific embodiments, but includes modifications described below.

Each center angle of the bridges 30 and 60 is preferably 90 degrees or less, a reasonable effect, however, can be obtained even if each center angle is 90 degrees or more, e.g. 120 degrees. Note that the center angle is preferably 90 degrees or less, if possible, approximately 60 degrees to make the bridge easily flexed as described in the first embodiment. The angle needs to be set with respect to the space where the bridges 30 and 60 each is disposed, therefore minimum angle within the available space is preferable.

The central parts 32 and 62 each of the bridges 30 and 60 is not restricted to the circular arcs, however, they may be obviously sharpened angles. Note that the circular arc is more advantageous for durability or the like.

Any curvature radius can be employed for each circular arc of the central parts 32 and 62. When the curvature radius is large, the central parts 32 and 62 each would be U-shaped rather than V-shaped, and the present invention includes such configuration.

Further, the bridges 30 and 60 each can entirely be a circular arc without an obvious bending part, i.e., it can be C-shaped, and such configuration can also obtain the effect for restricting overextension of the lock arms 22 and 42.

Furthermore, each bending part of the bridges 30 and 60 is not restricted to be V-shaped or U-shaped, it may be, however, W-shaped with a plurality of bending parts. In such case, each angle of the bending parts can be set appropriately.

The bridges 30 and 60 can be disposed at any position with no respect to the expected position of the pressing force F during disengagement. Note that each location of the bridges 30 and 60 on the axis of the force F is advantageous as the first and second embodiments.

The present invention is not restricted to the one including the guide bar 23 or 43 according to the first and second embodiments, however, the one without the guide bar 23 or 43 can be applied.

In the first and the second embodiments, the engaging part and the pressing part can be appropriately arranged. For instance, the engaging part 24 or 44 can be located on any position between the lock arms 22, or can be arranged at the tip end of the lock arm 22 as long as the position of the engaging part 24 or 44 is on a part of the lock arm 22. Further, the orientation of the lock arm 22 may be not only toward the lateral side of the socket 20 or 40 but also toward a flat side of the socket 20 or 40.

The pressing part 25 can also be arranged at any position of the lock arm 22 with an arbitrary orientation.

In other aspects, such as material for each part, producing methods, specific dimension, configuration can be appropriately set for putting the present invention into practice, and each aspect is included for the present invention.

What is claimed is:

1. A buckle comprising:

a socket;

a plug having a tip end to be inserted to the socket and to be released from the socket by pressing from both sides of the socket, the plug having a base formed on a base end, at least a pair of lock arms extending from the base to the tip end of the plug, at least one guide bar disposed between the look arms, an engaging part formed on a part of the lock arm to be engageable with the socket, and a pressing part disposed at a part of the lock arm to be pressed when the socket is released; and a bridge connecting the parts of at least the pair of the lock arms and extending around a tip end of the guide bar;

wherein the tip end of the guide bar is located on the side of the tip end of the plug relative to both ends of the bridge and the bridge extends around the tip end of the guide bar at a central part thereof without contacting the tip end of the guide bar; and wherein the central parl of the bridge is bent in a direction away from the base of the plug to extend around the tip end of the guide bar.

2. The buckle according to claim 1, wherein the bath ends of the bridge are located on the sides of the base end of the plug relative to the pressing part.

3. A buckle comprising:

a socket;

a plug having a tip end to be inserted to the socket and to be released from the socket by pressing from both sides of the socket, the plug having a base formed on a base end, at least a pair of lock arms extending from the base to the tip end of the plug, at least one guide bar disposed between the lock arms, an engaging part formed on a part of the lock arm to be engageable with the socket, and a pressing part disposed at a part of the lock ann to be pressed when the socket is released; and a bridge connecting the parts of at least the pair of the lock arms and extending around a tip end of the guide bar;

wherein the tip end of the guide bar is located on the side of the tip end of the plug relative to both ends of the bridge and the bridge extends around the tip end of the guide bar at a central part thereof without contacting the tip end of the guide bar; and wherein the both ends of the bridge are located on the sides of the base end of the plug relative to the pressing part.

4. The buckle according to claim 1 or 3, wherein the bridge is approximately V-shaped bent at the central part.

5. The buckle according to claim 4, wherein the center angle of the approximately V-shaped is 90 degrees or less.

* * * * *